US007856849B2

(12) United States Patent
McKeever et al.

(10) Patent No.: US 7,856,849 B2
(45) Date of Patent: Dec. 28, 2010

(54) INTERCHANGEABLE ORNAMENT RING

(75) Inventors: Alan McKeever, Milford, OH (US); Tina Yelton, Middletown, OH (US); Mark Fehrenbach, Fairfield, OH (US)

(73) Assignee: Yelton's Fine Jewelry, West Chester, OH (US)

( * ) Notice: Subject to any disclaimer, the term of this patent is extended or adjusted under 35 U.S.C. 154(b) by 465 days.

(21) Appl. No.: 11/833,738

(22) Filed: Aug. 3, 2007
(Under 37 CFR 1.47)

(65) Prior Publication Data

US 2008/0034792 A1 Feb. 14, 2008

Related U.S. Application Data

(60) Provisional application No. 60/821,881, filed on Aug. 9, 2006.

(51) Int. Cl.
*A44C 9/00* (2006.01)

(52) U.S. Cl. ..... 63/15; 63/40

(58) Field of Classification Search ..... 63/15, 63/15.2, 40, 3, 26, 29.1, 31
See application file for complete search history.

(56) References Cited

U.S. PATENT DOCUMENTS

| | | | | |
|---|---|---|---|---|
| 211,558 | A | 1/1879 | Edwards | |
| 253,667 | A * | 2/1882 | Bergfels | 63/26 |
| 672,366 | A * | 4/1901 | Herzog | 63/29.1 |
| 685,044 | A | 10/1901 | Huaussmann | |
| 732,334 | A | 6/1903 | Bohner | |
| 992,212 | A | 5/1909 | Tropin | |
| 1,032,025 | A | 7/1912 | Robbins | |
| 1,245,201 | A | 11/1917 | Depollier | |
| 1,553,198 | A | 9/1925 | Stern | |
| 1,710,734 | A | 4/1929 | Johnson | |
| 1,728,266 | A | 9/1929 | Fassnacht | |
| 1,792,534 | A | 2/1931 | Germain | |
| 1,920,875 | A | 8/1933 | Miskend | |
| 2,585,183 | A | 2/1952 | Stern | |
| 3,635,047 | A * | 1/1972 | Gilbert | 63/29.1 |
| 4,080,803 | A | 3/1978 | Suzuki | |
| 4,259,850 | A | 4/1981 | Lalieu | |
| 4,517,817 | A | 5/1985 | Levin | |
| 4,726,200 | A | 2/1988 | Carter | |
| 4,879,882 | A | 11/1989 | Johnson | |
| 4,977,757 | A | 12/1990 | Mesica | |
| 5,228,317 | A | 7/1993 | Hendricks | |
| 5,353,608 | A | 10/1994 | Berkowitz | |
| 5,375,434 | A | 12/1994 | Wertheimer | |
| D383,697 | S | 9/1997 | Bulgari | |
| 5,680,776 | A | 10/1997 | Shenhav | |
| 5,722,261 | A | 3/1998 | Lehrer | |

(Continued)

*Primary Examiner*—Victor Batson
*Assistant Examiner*—Emily M Morgan
(74) *Attorney, Agent, or Firm*—Wood, Herron & Evans, L.L.P.

(57) ABSTRACT

Shown is a ring for interchangeably displaying a bead-type ornament. The ring includes a shank portion for at least partially circling a user's finger. A support member extends away from the shank to a position spaced from the user's finger. A post extends from the support member toward the user and terminates in a free end. A bead-type ornament may be positioned on the post while the ring is not on a finger and is held captive by the support member and post when the ring is on a finger.

6 Claims, 4 Drawing Sheets

U.S. PATENT DOCUMENTS

| | | | | |
|---|---|---|---|---|
| 5,755,117 | A | 5/1998 | Shenhav | |
| D399,778 | S | 10/1998 | Bulgari | |
| 5,836,176 | A | 11/1998 | Lichtenstein | |
| 5,996,374 | A | 12/1999 | Bardisbanyan | |
| 6,053,009 | A | 4/2000 | Broggian | |
| D445,057 | S * | 7/2001 | Chanaratsopon et al. | D11/27 |
| 6,318,122 | B1 | 11/2001 | Burgard | |
| 6,381,985 | B1 | 5/2002 | Burgard | |
| 6,412,304 | B1 | 7/2002 | Adelman | |
| D471,836 | S * | 3/2003 | Chanaratsopon et al. | D11/27 |
| 6,601,408 | B2 | 8/2003 | Burgard | |
| D523,371 | S | 6/2006 | Bulgari | |
| 7,322,212 | B2 * | 1/2008 | Golove et al. | 63/15 |
| 2004/0035152 | A1 * | 2/2004 | Turrisi | 63/29.1 |
| 2004/0177647 | A1 * | 9/2004 | Dennis | 63/29.1 |

* cited by examiner

INTERCHANGEABLE ORNAMENT RING

PRIOR APPLICATION

This application claims the benefit of our U.S. Provisional Patent Application Ser. No. 60/821,881 filed Aug. 9, 2006.

COPYRIGHT MATERIAL

A portion of the disclosure of this patent document contains material which may be subject to copyright protection. The owner has no objection to the facsimile reproduction by anyone of the patent document or the patent disclosure, as it appears in the Patent and Trademark Office patent file or records, but otherwise reserves all copyright rights whatsoever.

TECHNICAL FIELD

The present invention relates to jewelry for displaying interchangeable objects, such as beads. The decorative object is held securely in place while the ring is on a user's finger, but is easily removable and interchangeable when the ring is removed from the user's finger.

BACKGROUND OF THE INVENTION

Due to the often significant price associated with fine jewelry pieces, flexibility which allows a piece to be customized to the purchaser's taste or daily wardrobe selection is useful and popular. Bead collecting, usually for bracelets and necklaces, has also become quite popular.

Others have developed various jewelry pieces that allow for more than one displayed ornament or bead. For example, U.S. Pat. No. 6,318,122, issued Nov. 20, 2001 to Gregg Burgard, entitled INTERCHANGEABLE ORNAMENT JEWELRY DISPLAY is one such example. The devices shown therein provide a relatively unstable platform for currently-popular beads having a relatively large diameter hole. Additionally, the ring shown therein holds an ornament bead a significantly distance away from the wearer's finger, thus presenting an awkward piece.

The present invention provides a novel approach for displaying beads or ornaments having a hole therein or therethrough.

SUMMARY OF THE INVENTION

The present invention provides a ring for interchangeably displaying a bead-type ornament or other ornament having an opening formed therein or there through. The ring includes a shank portion shaped in size to at least partially encircle the user's finger. A support member extends away from the shank to a position spaced from the user's finger. A post extends from the support member toward the user and terminates in a free end such that a bead or other ornament may be positioned on the post when the ring is not on a finger or is held captive by the support member and post when the ring is on a finger.

Other benefits, advantages, and objects of the present invention may be seen from careful examination of the following detailed descriptions of preferred embodiments and the various figures of the drawing, all of which comprise disclosure of the present invention. The jewelry device described here and is described and illustrated as a finger ring. It should be understood that variations on this theme, such as a toe ring or other body jewelry are included within the scope of the present invention described for use on a user's finger.

BRIEF DESCRIPTION OF THE DRAWING

Like reference numerals are used to indicate like parts throughout the various figures of the drawing, wherein.

DETAILED DESCRIPTION OF THE PREFERRED EMBODIMENTS

Figure 1:
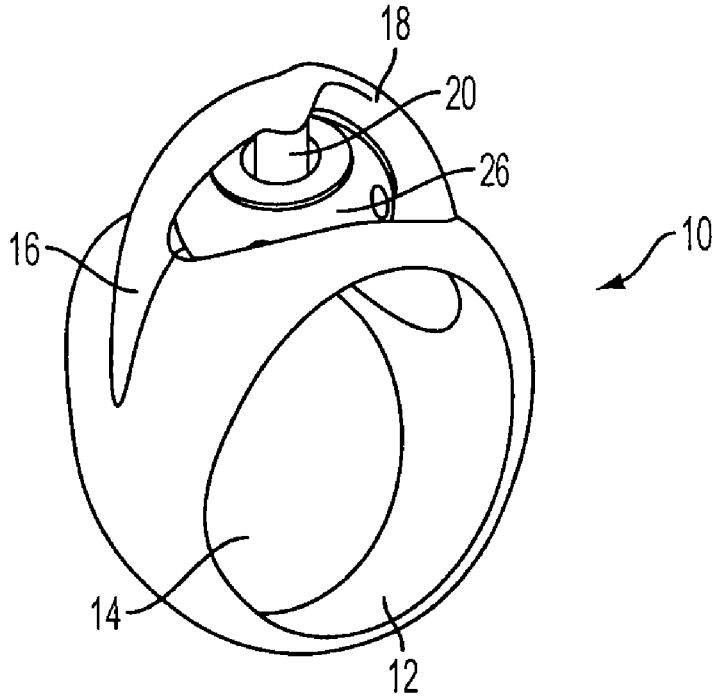
FIG. 1 is a pictorial view of a ring according to one embodiment of the present invention shown with an ornament bead in place.
Figure 2:
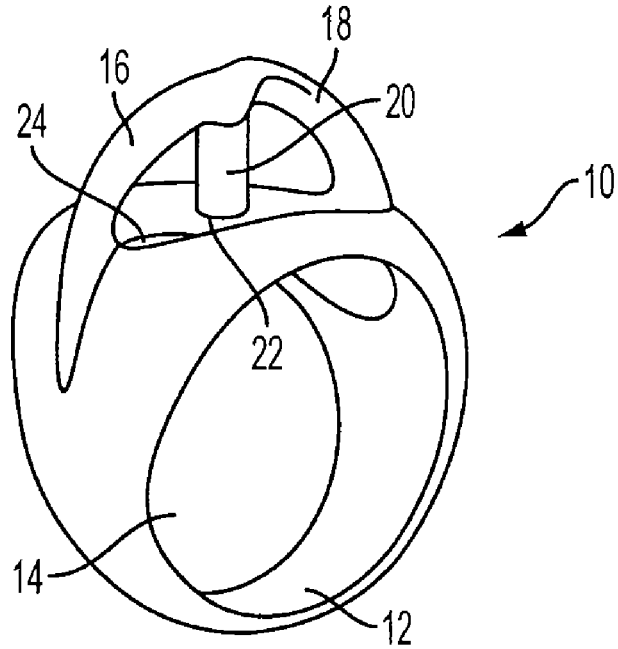
FIG. 2 is a view similar to FIG. 1 without an ornament in place.
Figure 3:
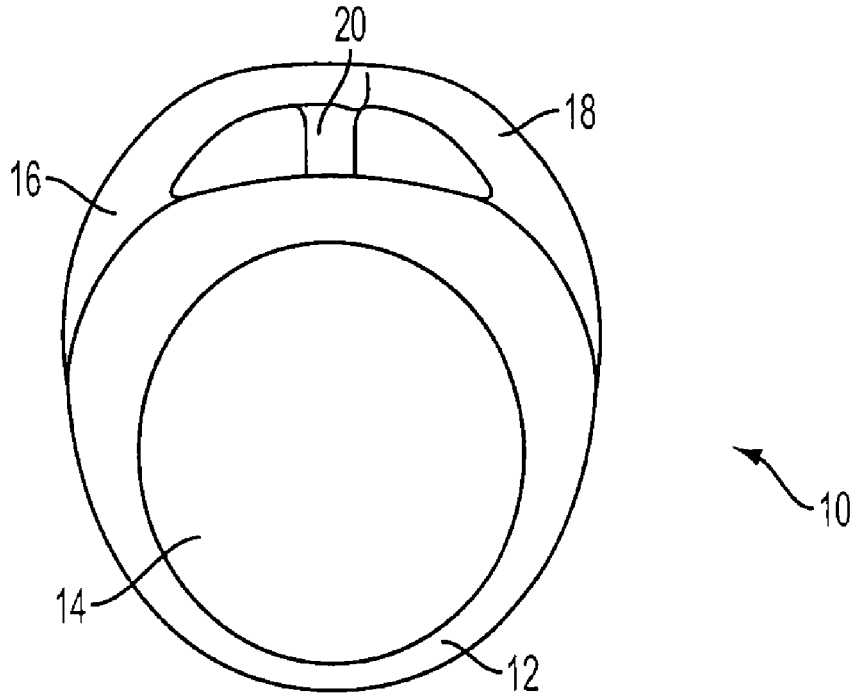
FIG. 3 is a side elevational view of the embodiment shown in FIG. 2.
Figure 4:
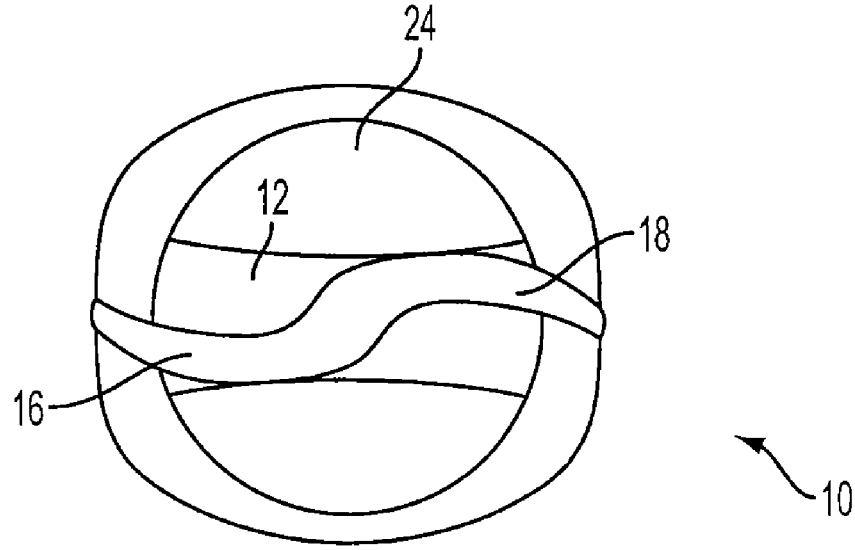
FIG. 4 is a top elevational view thereof.

The present invention provides a device with no moving parts for interchangeably displaying a bead or similar ornament as a piece of jewelry in the form of a finger ring. Glass beads, such as those popularly sold under the trademark TROLLBEADS™ by Lund Trading, LLC of Columbia, Md. or PANDORA™ sold by Pandora Jewelry, LLC, also of Columbia, Md. Pandora Jewelry, LLC is also the owner of U.S. Pat. No. 7,007,507 relating to necklaces and bracelets for displaying such beads. These beads are made of glass, precious metals, and/or gem stones. These popular beads may include a wide variety of color patterns, textures, and shapes, but most are generally within a predetermined range of diameter and thickness.

Referring to the various figures of the drawing, and first to FIGS. 1-4, therein is shown at 10 a ring according to a first embodiment of the present invention. The ring 10 includes a shank 12 which defines an opening 14 that is sized to fit comfortably on, for example, a user's finger. As used herein, "finger" is understood to include a toe or even an arm of a wearer, depending on how the item is sized. Extending outwardly from the band formed by the shank 12 is at least one support member 16, 18. A post 20 extends from the support member 16, 18 generally toward the user's finger and terminates at a free end 22. Inwardly of the post 20 can be an opening 24. An ornamental bead 26 may be placed on the post 20 by inserting it into the finger opening 14, lifting it through the opening 24 and positioning its bore opening over the free end 22 and onto the post 20. Once the user's finger is inserted into the ring opening 14, the bead 26 is held captive. As desired, the bead 26 may be permitted or not permitted to rotate on the post 20. Alternatively, the post 20 may be threaded to engage a bead 26 having a threaded bore, such as the aforementioned and well known PANDORA™ brand beads.

As used herein, "bead" and "bead-type ornament" is meant to include any ornament which has a bore formed partially or fully therethrough, regardless of specific shape, style, or material.

Figure 5:
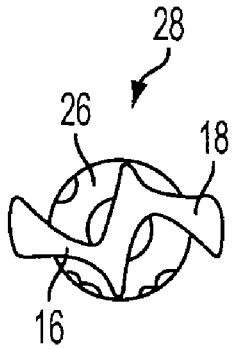
FIG. 5 is a top elevational view of a second embodiment of the present invention shown with an ornament bead.
Figure 6:
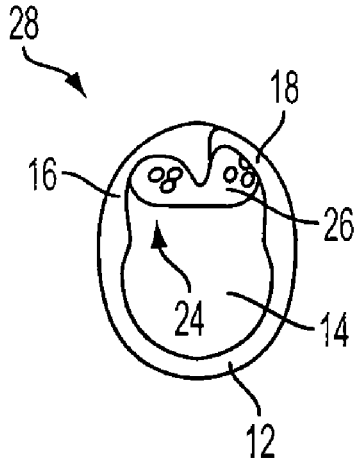
FIG. 6 is a front elevational view of the embodiment shown in FIG. 5.
Figure 7:
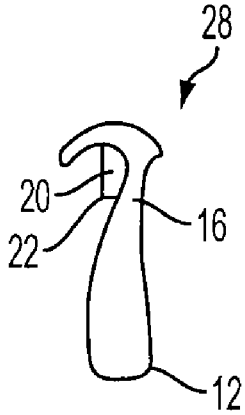
FIG. 7 is a side elevational view of the embodiment shown in FIGS. 5 and 6, without the ornament bead.
Figure 8:
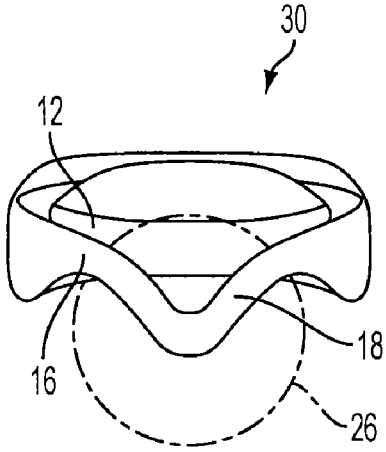
FIG. 8 is a top elevational view of a third embodiment of the present invention.
Figure 9:
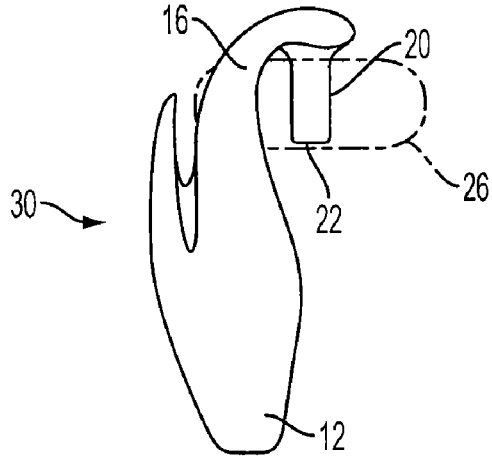
FIG. 9 is a side elevational view thereof.
Figure 10:
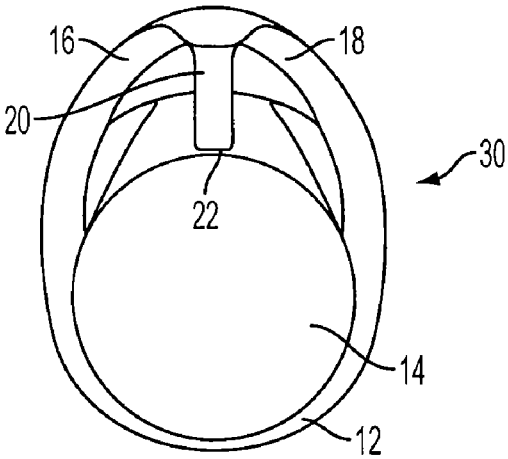
FIG. 10 is a front elevational view thereof.
Figure 11:
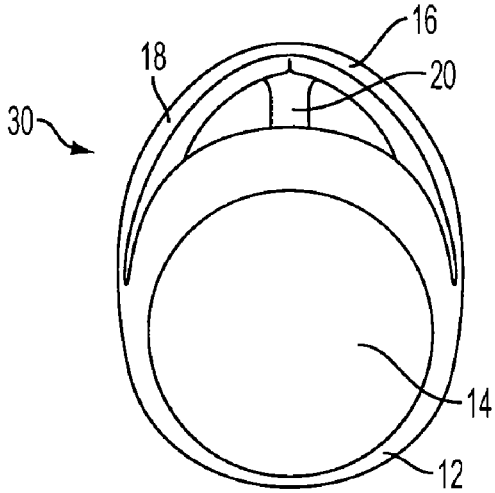
FIG. 11 is a back elevational view thereof.

Referring now to FIGS. 5-7, therein is shown at 28 a second embodiment of the present invention. This embodiment 28 also includes a shank portion 12 but has a less defined or partially defined top portion of the opening 24 into which the bead 26 is lifted for placement on the post 20.

Referring now to FIGS. 8-11, therein is shown at 30 a third embodiment of the present invention in which the post 20 is slightly forwardly offset from the shank portion 12 of the ring. The three embodiments shown herein include ornamental aspects in addition to their functional variations in structure. The ornamental aspects of these designs may be the subject of copyright and/or design patent protection.

Many other variations in ring designs may be made without departing from the spirit and scope of the present invention. For example, a single support member (16 or 18) may extend from the shank portion 12 from either a side or the front of the ring toward a position to support the post 20. So long as the post 20 is supported and the free end 22 extended in a manner which allows an ornament having an opening therein or therethrough to be lifted into position for placement on the post 20 when the ring 10, 28, 30 is not on the user's finger and is held captive when the ring 10, 28, 30 is placed on the user's finger, such a device is considered to be within the spirit and scope of the present invention. Accordingly, patent protection is not to be limited by the specific embodiments disclosed herein, but by the following claim or claims, interpreted in accordance with legal concepts of claim construction.

What we claim is:

1. A ring for interchangeably displaying a bead-type ornament, comprising:

a ring shank sized and shaped to at least partially encircle a wearer's finger;

a support member extending generally away from the shank to a position spaced from a wearer's finger; and a post extending from the support member generally toward the wearer's finger and terminating in a free end positioned near the wearer's finger, wherein, a bead-type ornament can be placed on and removed from the post when the ring is not on the wearer's finger and is captured on the post when the ring is in place on the wearer's finger.

2. The ring of claim 1, wherein the post includes threads sized and shaped to engage complementary threads in a bead-type ornament.

3. The ring of claim 1, wherein the shank includes a top portion at least partially defining an opening through which the ornament passes for placement on and removal from the post.

4. The ring of claim 3, wherein the top portion defines an opening through which the ornament is passed for placement on and removal from the post.

5. The ring of claim 1, comprising a plurality of support members extending from the shank to support the post.

6. The ring of claim 3, comprising a plurality of support members extending from separate positions adjacent a periphery of the opening to support the post.

* * * * *